United States Patent [19]

Desoutter

[11] Patent Number: 4,652,006

[45] Date of Patent: Mar. 24, 1987

[54] SHORT AND WIDE SKI WITH A PARTICULAR PROFILE AND PROVIDED WITH A MOVABLE RETAINER PLATE

[76] Inventor: Michel Desoutter, 24, chemin des Cloches, 74000 Annecy-Le-Vieux, France

[21] Appl. No.: 704,320

[22] PCT Filed: Jun. 4, 1984

[86] PCT No.: PCT/FR84/00143

§ 371 Date: Jan. 30, 1985

§ 102(e) Date: Jan. 30, 1985

[87] PCT Pub. No.: WO84/04693

PCT Pub. Date: Dec. 6, 1984

[30] Foreign Application Priority Data

Jun. 2, 1983 [FR] France ..... 83 09451

[51] Int. Cl.[4] ..... A63C 7/08; A63C 5/04

[52] U.S. Cl. ..... 280/604; 280/609; 280/610

[58] Field of Search ..... 280/609, 602, 607, 12 AA, 280/12 AB, 12 B, 604, 605, 610; 188/8

[56] References Cited

U.S. PATENT DOCUMENTS

| | | | |
|---|---|---|---|
| 3,628,804 | 12/1971 | Carreiro | 280/609 |
| 3,655,211 | 4/1972 | Bollettieri et al. | 280/11.13 S |
| 3,724,866 | 4/1973 | Kaplan | 280/607 |
| 3,854,739 | 12/1974 | Toda et al. | 280/11.13 S |
| 3,861,698 | 1/1975 | Greig | 280/604 |
| 4,065,150 | 11/1977 | Van Auken | 280/610 |
| 4,288,092 | 9/1981 | Mukri | 280/609 |

FOREIGN PATENT DOCUMENTS

| | | | |
|---|---|---|---|
| 2013061 | 9/1971 | Fed. Rep. of Germany | 280/609 |
| 2913250 | 10/1980 | Fed. Rep. of Germany | 280/610 |
| 2937574 | 4/1981 | Fed. Rep. of Germany | 280/605 |
| 2337564 | 8/1977 | France | 280/601 |
| 2502504 | 10/1982 | France | 280/604 |
| 8404693 | 12/1984 | World Int. Prop. O. | 280/609 |
| 153866 | 7/1932 | Switzerland | 280/609 |
| 171411 | 8/1934 | Switzerland | 280/604 |
| 504877 | 5/1971 | Switzerland | 280/609 |

*Primary Examiner*—John A. Pekar
*Assistant Examiner*—Eric D. Culbreth
*Attorney, Agent, or Firm*—Ratner & Prestia

[57] ABSTRACT

The ski has a width which substantially doubles that of a ski for downhill or excursion skiing, and is comprised between 12 and 15 centimeters, and its length is five to seven times its width. The ski comprises a cambered portion forming a concave bottom surface and separated from the spatula by a substantially planar portion. The rear part of the cambered portion is planar and goes down under the plane defined by the planar portion. A removable retainer plate is inserted under the sole of the ski and comprises retainer clips enabling to ski uphill.

8 Claims, 4 Drawing Figures

SHORT AND WIDE SKI WITH A PARTICULAR PROFILE AND PROVIDED WITH A MOVABLE RETAINER PLATE

BACKGROUND OF THE INVENTION

The present invention relates to devices for travelling over virgin or packed snow, either uphill, or downhill, or on the flat, as well as for traversing.

The devices used at the present time are of several kinds: snowshoes allow step by step walking, avoiding any sliding, but limit the travel to slopes of less than 18°; apprenticeship is easy, but use thereof is relatively fastidious and their possibilities limited—long distance skis, a ski narrow and long having a width less than 5 cm and a length of about 1.8 m, can be used on the flat or on limited uphill and downhill slopes; the long distance ski is difficult to use on non packed snow, for which it requires a long and fastidious apprenticeship—downhill skis are relatively wider and shorter, having a width of about 7 cm and a length of about 1.8 m for the long skis and about 1.5 m for the compact skis, are adapted only for downhill runs. They require a long and fastidious apprenticeship, sophisticated equipment such as special shoes, and relatively sporting abilities on the part of the user. They can be used for going uphill by fitting a removable antislip skin under the sole of the ski. Uphill use is limited to slopes less than about 25°.

It can be seen that each of the known devices is precisely adapted for a particular use, downhill, on the flat or uphill running. All these devices have limits of use which prevent use thereof by the largest number of users without particular physical ability.

Recently, attempts have been made to make downhill skis accessible to the largest number, by reducing their length and increasing their width, thus providing compact skis having a length of about 1.5 m and a width of 8 to 9 cm, which are easier to use. However it has been discovered that, after the first craze, users gradually chose longer skis more adapted to use on a tamped ski run.

SUMMARY OF THE INVENTION

The object of the present invention is in particular to overcome the disadvantages of known devices by proposing a new type of short and wide ski, having a particular profile and usable practically without apprenticeship on the flat, uphill, downhill or for traversing. The object of the invention is not to allow the performances of known equipment, for each one in its field of application, but offers a satisfactory synthesis for travelling over any snow; uphill, downhill and across slopes up to 45°; slided steps on the flat like the long distance ski; the particular profile of the ski further providing without wax or retainer plate uphill advance without slipping on slopes going up to 20°; downhill travel on any kind of snow by sliding like the downhill ski.

Particular arrangements ensure the stability of the ski of the present invention despite its short length, and increases its lift on unpacked snow; furthermore, they ensure a nonslip function for uphill travel which allows skis to be used without a retainer plate on slopes up to about 20°, the rear of the ski tending to dig into the snow. They also allow breaking on downhill runs, without retainer plate by rearward tilting of the body of the user.

To attain these objects as well as others, the present invention plans to provide a ski whose width is substantially twice that of a downhill or excursion ski, that is to say a width between 12 and 15 cm; furthermore, the length of the ski must be between 5 and 7 times its width. These proportions are very different from those used for conventional skis. The ski thus constructed, of a length of about 80 cm is considerably shorter than all the skis proposed up to the present time, which is contrary to the present development of lengthening skis and progressively abandoning compact skis.

In a way known per se, the ski according to the present invention comprises a front spatula, a bearing zone and bindings. The bearing zone is cambered so as to form a lower concave surface. According to another feature of the invention, the lower surface of the bearing zone comprises a substantially flat front portion defining a plane of reference; the front portion is joined forwardly to the spatula and rearwardly to a generally concave cambered portion disposed above the reference plane; the cambered portion is joined rearwardly to a flat rear part going down below the reference plane.

According to another feature, the ski is relatively stiff; its stiffness is chosen so that a force of about 1200 Newtons, applied perpendicularly to the middle of its upper face, produces a flexion of 1 to 3 cm of the central zone, with the two ends blocked. This stiffness is appreciably greater than that of known skis.

According to another feature of the invention, the device further comprises a removable lower plate, substantially rectangular in shape, comprising clips projecting from its lower face and means for fixing it and fitting it under the sole of the ski. Its length is substantially equal to a quarter of the length of the ski, and is fixed so as to cover the third rear quarter of the sole of the ski.

BRIEF DESCRIPTION OF THE DRAWINGS

Other features and advantages of the present invention will be clear from the following description of a particular embodiment made with reference to the accompanying figures, in which.

DESCRIPTION OF THE PREFERRED EMBODIMENT

Figure 1:
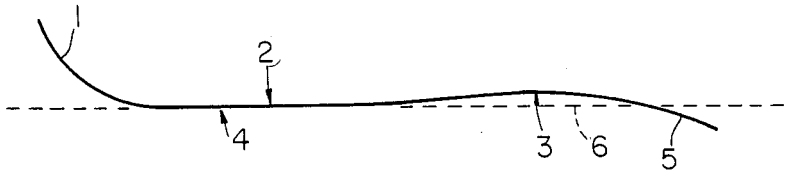
FIG. 1 is a profile view of the ski according to the invention.

As shown in the Figures, the ski according to the present invention comprises a front spatula 1, a bearing zone 2, and bindings, not shown in the Figures, for fitting a shoe to the upper surface of the ski. The bearing zone 2 is calibrated so as to form a lower concave surface 3.

The width of the ski according to the present invention is substantially twice that of a conventional downhill or excursion ski, that is to say that it is between 12 and 15 cm. Its length is between 5 and 7 times its width. Preferably, a standard model may be defined having a length of 81 cm, a width of 14 cm and a junior model having a length of 76 cm and a width of 13 cm. Numerous tests carried out have shown that these proportions give the best compromise for use on all kinds of snow and all slopes.

The bearing zone 2 of the ski, or more precisely its lower surface, comprises a substantially flat front portion 4 which defines a plane of reference 6. The front portion 4 is joined forwardly to the spatula 1 and forms a good sliding surface. The front portion 4 is joined rearwardly, by a convex zone, to a generally concave cambered portion 3 developing above the plane of reference 6. The cambered portion 3 is joined rearwardly to the flat rear part 5 going down below the plane of reference.

In use, the skier may adopt attitudes leaning forwards or rearwards to a greater or lesser degree. While for uphill work, an attitude leaning slightly rearwardly promotes penetration of the rear part 5 into the snow, avoiding back sliding. During downhill runs, a rear position promotes a certain breaking by penetration of the rear part 5, whereas a more forward position promotes sliding by transferring the weight to the flat portion 4.

Preferably, the flat rear part 5 of the bearing zone 2 forms with the plane of reference 6 an angle between 3° and 6° in the absence of deformation, that is to say when the ski is in the rest condition. It has been discovered that these values give a good compromise between downhill sliding and the antiback-sliding function.

The flat front portion 4 of the bearing zone 2 has a length between a third and a half of the total length of the ski.

The stiffness of the ski is chosen so that a force of about 1200 Newtons, applied perpendicularly to the middle of its upper face, produces a flexion of 1 to 3 cm of the central zone, with the ends blocked.

Figure 3:
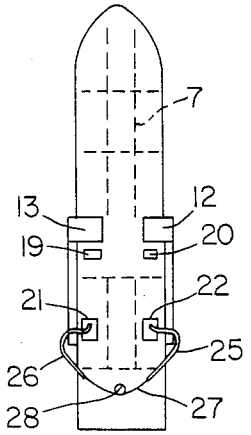
FIG. 3 is a top view of the ski with retainer plate.
Figure 4:
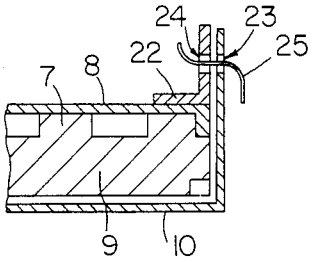
FIG. 4 is a partial cross section of the ski and of the retainer plate.

The structure of the ski comprises a glass fiber or carbon fiber reinforced polyester web comprising upper longitudinal and transverse ribs 7 shown with broken lines in FIG. 3. An upper cover 8, shown in FIG. 4, is added and firmly secured to the polyester web 9. Securing may be carried out when hot by thermoforming, or by any other means such as bonding, welding.

Figure 2:
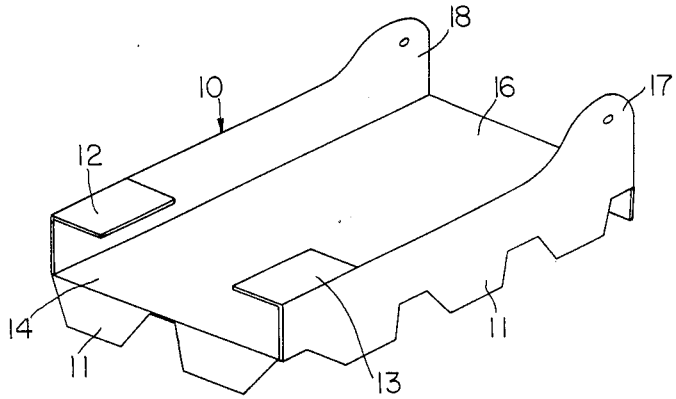
FIG. 2 is a perspective view of the retainer plate.

The device further comprises a lower removable plate 10 intended to be fitted to the lower surface of the ski. This plate 10, shown in FIG. 2, has a substantially rectangular shape and comprises clips 11 projecting from its lower face and fixing means for fitting it and fixing it under the sole of the ski. The fixing means comprise two hook shaped guide lugs 12 and 13 disposed on the front part 14 of the upper face of the plate, and shaped so as to allow the ski to pass between the upper face of plate 10 and lugs 12,13 to be held as shown in the Figures. The plate further comprises, on the rear part 16 of its upper face, two longitudinal vertical lugs 17 and 18 with a spacing therebetween slightly greater than the width of the ski, as shown in FIG. 2.

The device for fixing the plate to the ski further comprises two stops 19 and 20 fixed to the upper surface of this ski and against which the guide lugs 12 and 13 come into abutment as shown in FIG. 3. The ski further comprises two upper brackets 21 and 22 fixed to the upper surface. When the plate is in position, in abutment against stops 19 and 20, the rear vertical lugs 17 and 18 of the plate come opposite brackets 21 and 22. Lugs 18 and 17 and brackets 21 and 22 are provided with corresponding holes 23 and 24, as shown in FIG. 4, for passing therethrough assembly rods 25 and 26 joined together by an elastic 27 passing behind a tensioning stud 28 fixed to the upper surface of the rear part 5 of the ski.

The plate is fitted to the ski in the following way: the front part of the ski is fitted between the face of plate 10 and guide lugs 12, 13 of the plate and, when these lugs are in abutment against stops 19 and 20, the upper surface of the plate is urged against the lower surface of the ski, bringing holes 23 and 24 into alignment, rods 25 and 26 are inserted which are curved as shown in the Figures, and the elastic 27 is passed behind stud 28.

Plate 10 may be formed by any means, and for example by stamping and bending portions of a metal sheet.

The bindings, not shown in the Figures, may be downhill ski bindings but, preferably, are excursion or long distance ski bindings with possibility of locking the heel of the shoe on the ski for downhill runs.

Preferably, plate 10 has a length substantially equal to a quarter of the length of the ski and stops 19, 20 and brackets 21, 22 are disposed such that the plate is positioned so as to cover the third rear quarter of the sole of the ski.

The present invention is not limited to the embodiments which have been explicitly described, but includes the different variations and generalizations thereof contained within the scope of the following claims.

I claim:

1. A ski for traveling over snow whose width is substantially twice that of a downhill or excursion ski and whose length is between five and seven times said width, comprising:

a front spatula, a bearing zone having a lower surface comprising a substantially flat front portion and a generally concave rear portion, a removable lower plate having a substantially rectangular shape, comprising clips projecting from its lower face and fixing means for fitting it and fixing it under the ski, wherein the plate comprises on the front part of its upper face two hook shaped guide lugs between which the ski slides, the lugs coming into rear abutment against two stops disposed on the upper face of the ski, the plate further comprising on the rear part of its upper face two vertical lugs coming opposite corresponding bracket lugs fixed to the upper surface of the ski, the lugs and brackets having through holes for passing therethrough two curved assembly rods joined together by an elastic means intended to hold them engaged in the holes after tensioning about a rear stud of the ski.

2. The ski according to claim 1, in which said substantially flat front portion defines a plane of reference joined forwardly to the spatula, wherein the front portion is connected rearwardly to the concave portion, the concave cambered portion disposed being above the reference plane, the cambered portion being joined rearwardly to a substantially flat rear part going down below the plane of reference.

3. The ski according to claim 2, wherein the flat rear part of the bearing zone forms with the plane of reference an angle between 3° and 6° in the absence of deformation.

4. The ski according to claim 2, wherein the flat front portion of the bearing zone has a length between a third and a half of the length of the ski.

5. The ski according to claim 1, wherein its stiffness is chosen so that a force of about 1200 Newtons applied perpendicularly to the middle of its upper face produces a flexion of 1 to 3 cm of the central zone, with front and rear ends of the ski blocked.

6. The ski according to claim 1, in which the ski is formed of glass fiber reinforced polyester through said ski comprising longitudinal and transverse upper ribs.

7. Ski according to claim 6, wherein there is further provided an upper cover added and fixed to the web.

8. Ski according to claim 1, wherein plate has a length substantially equal to a quarter of the length of the ski, and is fixed so as to cover the rear third quarter of the sole of the ski.

* * * * *